United States Patent [19]

Cleveland

[11] Patent Number: 5,010,909

[45] Date of Patent: Apr. 30, 1991

[54] KNOCK-DOWN DEER BLIND

[76] Inventor: Thomas J. Cleveland, P.O. Box 153, Carlsbad, Tex. 76934

[21] Appl. No.: 510,121

[22] Filed: Apr. 17, 1990

[51] Int. Cl.[5] ..... E04H 15/00

[52] U.S. Cl. ..... 135/901; 135/119

[58] Field of Search ..... 135/900-902, 135/101, 115, 119, 117

[56] References Cited

U.S. PATENT DOCUMENTS

| | | | |
|---|---|---|---|
| 2,600,501 | 6/1952 | Higgs | 135/101 X |
| 3,116,808 | 1/1964 | Riley | 135/900 X |
| 3,419,024 | 12/1968 | Nickerson, Jr. | 135/902 X |
| 3,913,598 | 10/1975 | Glutting, Jr. et al. . | |
| 3,925,828 | 12/1975 | Kim | 135/902 X |
| 4,084,597 | 4/1978 | Compton | 135/901 X |
| 4,364,193 | 12/1982 | Visco | 135/901 X |
| 4,388,939 | 6/1983 | Barton . | |
| 4,473,087 | 9/1984 | Cavender . | |
| 4,716,919 | 1/1988 | Griffin . | |
| 4,798,019 | 1/1989 | Sury et al. | 135/901 X |

*Primary Examiner*—David A. Scherbel
*Assistant Examiner*—Lan Mai
*Attorney, Agent, or Firm*—Fleit, Jacobson, Cohn, Price, Holman & Stern

[57] ABSTRACT

A knock-down three dimensional rectangular frame is provided as well as an upstanding flexible material sleeve downwardly telescopingly engagable over the frame. The lower end of the sleeve is peripherally openable and removably closable and the upper and lower ends of sleeve include inwardly directed marginal flaps extending fully peripherally thereabout disposable over and under, respectively, the upper and lower ends of the skeletal frame. The sleeve is constructed of a material which may have a camouflaged design on its outer surface and which is preferably substantially air impervious.

6 Claims, 2 Drawing Sheets

KNOCK-DOWN DEER BLIND

BACKGROUND OF THE INVENTION

1. Field of the Invention

This invention relates to a three dimensional knock-down skeletal frame including generally parallel upper and lower open frames and a plurality of upright space members spaced about the frames and extending between corresponding corners thereof. An upstanding, flexible fabric sleeve is provided and telescopingly disposable over the skeletal frame from the upper end thereof. The skeletal frame and fabric sleeve, together, provide hunters with a blind which may be readily transported in a compact state and quickly erected at a hunting site.

2. Description of Related Art

Various different forms of collapsible hunting blinds as well as other collapsible structures heretofore have been provided such as those disclosed in U.S. Pat. Nos. 3,913,598, 4,388,939, 4,473,087 and 4,716,919. However, these previously known structures do not include the overall combination of structural and operational features of the instant invention.

SUMMARY OF THE INVENTION

The blind of the instant invention includes a three dimensional rectangular skeletal frame which is preferably dimensioned as a cube having six equal dimension sides. In addition to the frame an upstanding sleeve of flexible fabric is provided and is telescopingly downwardly engagable over the frame from above. The upper and lower ends of the sleeve include peripherally extending and inwardly directed marginal flaps extending fully peripherally thereabout. One of the sleeve lower end flaps, adjacent the longitudinal mid-portion of the corresponding side of the frame, has a slot formed completely therethrough, but is provided with releasable connecting structure and the corresponding side of the cover includes a slit forming an upward extension of the slot and the slit is removably closable by a slide-type fastener. Accordingly, with the slide-type fastener open, the sleeve may be readily downwardly telescoped over the frame and the inwardly directed flaps at the lower end of the sleeve then may be directed inwardly of under the lower portion of the frame, after which the slide-type fastener may be closed and the releasable connecting structure may be used to close the slot.

Although the blind is specifically designed to be erected at a hunting location, the blind, even when fully erected, may be transported from one location to another as long as the hunting location is not heavily wooded.

The main object of this invention is to provide a hunting blind which may be readily transported to and from selected hunting locations.

Another object of this invention is to provide a knock-down hunting blind which is of light weight construction and which may be readily erected at a selected hunting site.

Still another object of this invention is to provide a hunting blind constructed of readily available materials to thereby maintain the cost of the hunting blind as low as possible.

A further object of this invention is to provide a hunting blind which may accommodate more than one person.

A final object of this to be specifically enumerated herein is to provide a hunting blind in accordance with the preceding objects and which will conform to conventional forms of manufacture, be of simple construction and easy to use so as to provide a device that will be economically feasible, long-lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
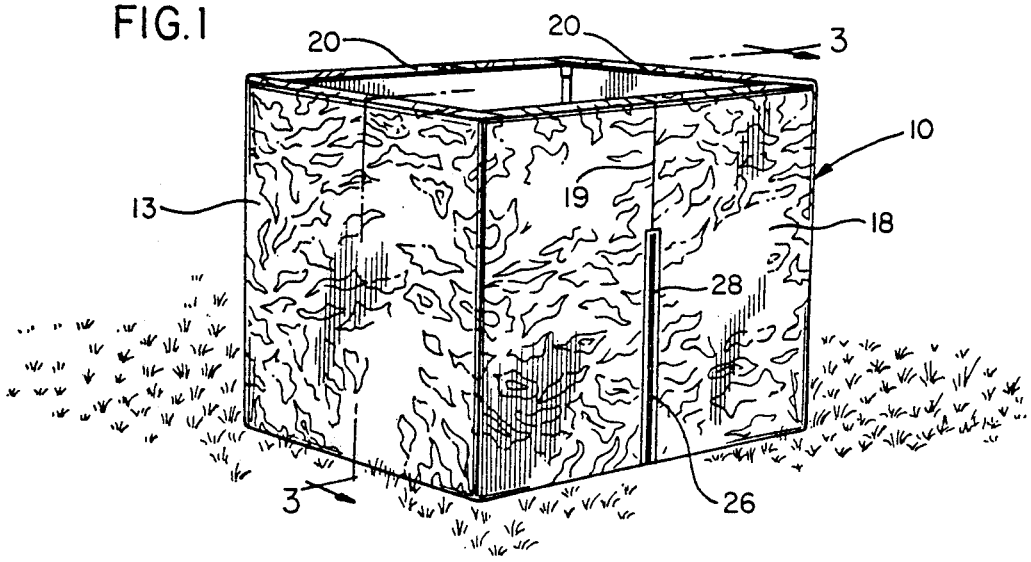
FIG. 1 is a perspective view of the hunting blind in a fully erected condition.
Figure 2:
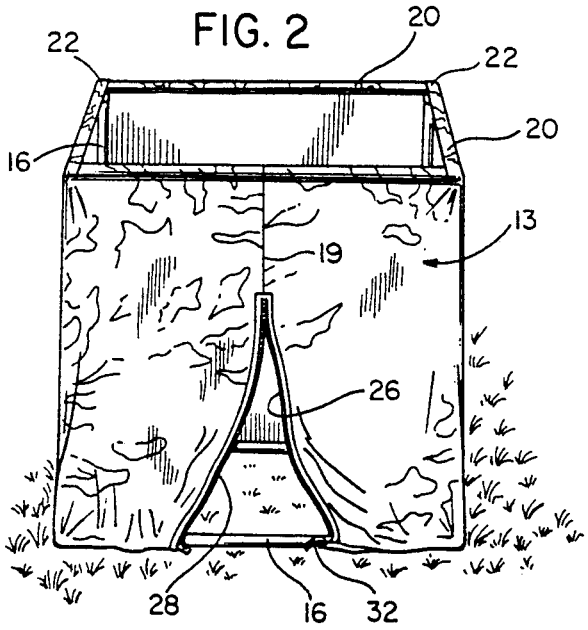
FIG. 2 is a perspective view of the hunting blind with the lower end slot in an open condition and the slide fastener provided for removably closing the slit in the cover forming an upward extension of the slot in a substantially fully open position.
Figure 4:
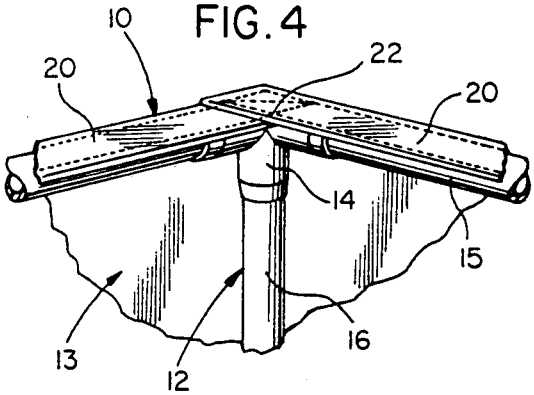
FIG. 4 is a fragmentary enlarged perspective view of one of the upper corner portions of the blind.
Figure 5:
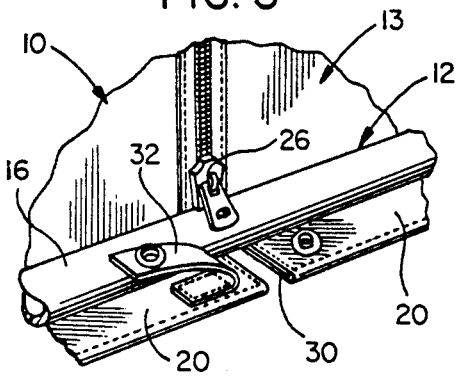
FIG. 5 is a fragmentary perspective view of the lower portion of the which an entranceway may be made.

Referring now more specifically to the drawings the numeral 10 generally designates the knock-down deer blind of the instant invention. The blind 10 includes a three dimensional rectangular frame referred to in general by the reference numeral 12 and a flexible fabric sleeve referred in general by the reference numeral 13 removably secured over the frame 12.

The frame 12 comprises eight identical corner T-fittings 14 constructed of PVC and twelve equal length PVC tubing sections 16. The ends of the tubing sections 16 are removably telescopingly engagable in the fittings 14 and, if desired, four of the tubing sections 16 may have the corresponding fittings 14 permanently secured to the opposite ends thereof, thereby limiting the total number of loose parts of the frame 12 to twelve and preventing loss of the fittings 14.

Figure 6:
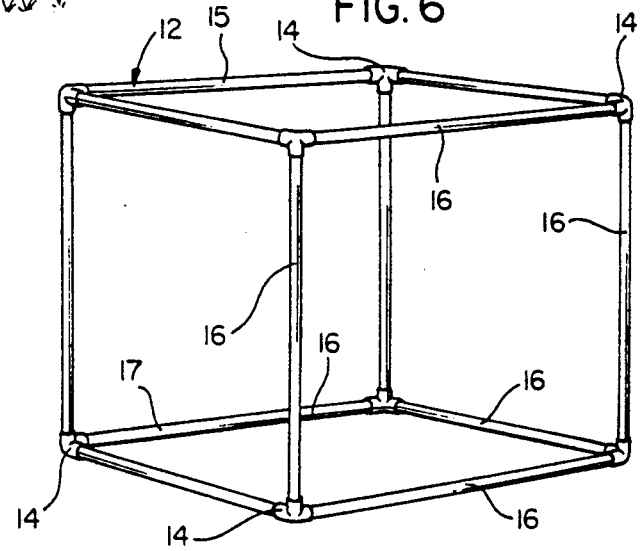
FIG. 6 is a perspective view of the skeletal frame of the blind.
Figure 3:
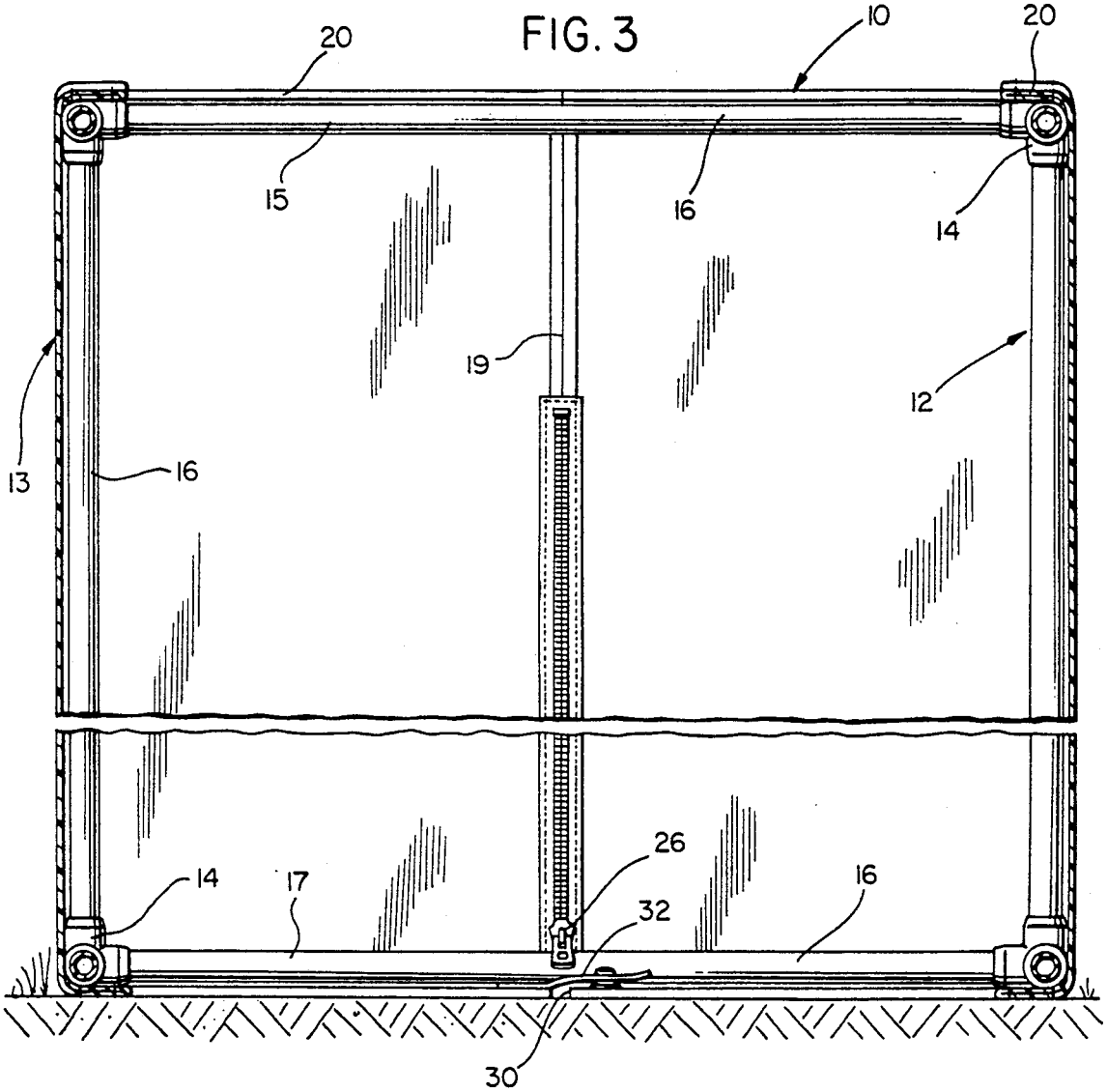
FIG. 3 is an enlarge vertical sectional view taken substantially upon the plane indicated by the section line 3—3 of FIG. 1.
Figure 7:
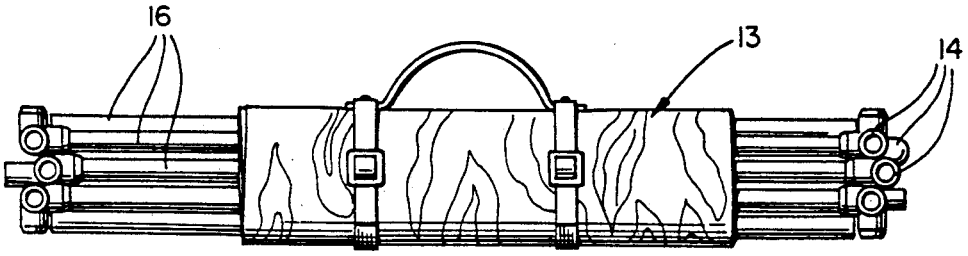
FIG. 7 is a perspective view of the blind in a fully collapsed position for ease and transport from one location to another.

In any event, the fittings 14 and tubular sections 16 may be removably assembled relative to each other in the manner illustrated in FIG. 6 to define upper and lower open frames 15 and 17 joined by four tubing sections or spacing members 16. Then, the sleeve 13 may be telescoped downwardly over the frame 12 in order to provide the completed blind shown in FIG. 1.

The sleeve 13 includes a single section or length 18 of flexible material having its opposite ends joined together as at 19 and including interrupted opposite longitudinal marginal flaps 20 at each end equal in number to the marginal members or tubular sections 16 of the corresponding frames 15 and 17. The flaps 20 are turned inwardly and their adjacent ends are sewn together as at 22.

The lower portion of the joining of the opposite ends of the section or length 18 is accomplished through the utilization of a slide-type fastener 26, the fastener 26 being operable to selectively open and close a vertical slit 28 generally centered relative to one side of the frame 12. The corresponding flap 20 includes a slot 30 formed completely therethrough and communicating with the slit 28. The slot 30 is removably closable by a snap fastener equipped closing strap 32.

The section or length 18 of flexible material may have a camouflaged design on the outer surface thereof and, preparatory to the sleeve 13 being telescoped over the frame 12, the slot 30 and slit 28 are opened. Then, the sleeve 13 is downwardly telescoped over the frame 12 and the lower marginal portions of the sleeve 13 are slipped inward under the fittings 14 and tube sections 16 at the lower extremity of the frame 12. Thereafter, the strap 32 is removably secured across the slot 30 and, after the user of the blind 10 has entered the latter through the slit 28, the latter is closed by the slide fastener 26.

However, once the blind 10 has been erected, a user thereof may readily exit from the blind 10 merely be tilting the blind 10 in one direction and slipping under the opposite side of the blind. Of course, entrance to the interior of the blind may be gained in a similar manner and in practice it has been found that the slot 30 and closing strap 32 as well as the slit 28 and closing slide fastener 26 actually serve a more important function than entry into and exit from the blind 10 in that the slot 30 and slit 28, when open, greatly facilitate downward telescoping engagement of the sleeve 13 over the frame 12.

It is also to be pointed out that the blind 10 is of such light weight construction that it may be readily moved from one location to another, even while assembled and even while a user of the blind is disposed therewithin as long as the blind is not in a heavy brush or heavily wooded area.

Of course, the slide fastener and strap 32 serve to close the lower portion of the sleeve 13 tightly about the bottom of the frame 12 and thereby prevent removal of the sleeve 13 from the frame 12 until such time as the strap 32 is disengaged and the slide fastener 36 is opened.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A hunting blind including a skeletal frame incorporating upper and lower open frames of generally the same shape and the same size, said upper and lower frames each including a plurality of relatively angulated, generally horizontal and substantially straight marginal members releasably interconnected at adjacent ends to define corner portions between peripherally adjacent marginal members, corresponding corner portions of said frames being joined by elongated, generally straight and upstanding spacing members including upper and lower ends releasably connected to corresponding corner portions of said upper and lower frames, respectively, and extending therebetween, and a cover for said skeletal frame including an upstanding peripherally continuous sleeve of flexible material having open upper and lower ends, said sleeve being downwardly telescoped over said frame, the upper end of said sleeve including inwardly directed peripherally adjacent and extending upper end flaps projecting inwardly over the marginal members of said upper frame, adjacent ends of said flaps being secured relative each other, said sleeve also including peripherally extending lower end flaps on its lower end directed inwardly beneath said lower frame, said sleeve, intermediate the opposite ends of one of said lower end flaps including a slot cut through said one lower end flap and also an upstanding slit extending upwardly along said sleeve from the lower end thereof to a point spaced below the upper end thereof, said slot and slit including communicated adjacent ends, means removably closing said slit, and means releasably closing said slot.

2. The hunting blind of claim 2 wherein said sleeve includes an outer surface having a camouflage design.

3. The hunting blind of claim 2 wherein said upper and lower frames each include corner connectors removably joining adjacent ends of the corresponding marginal members.

4. A hunting blind including a skeletal frame incorporating upper and lower open frames of generally the same shape and the same size, said upper and lower frames each including a plurality of relatively angulated, generally horizontal and substantially straight marginal members releasably interconnected at adjacent ends to define corner portions between peripherally adjacent marginal members, corresponding corner portions of said frames being joined by elongated, generally straight and upstanding spacing members including upper and lower ends releasably connected to corresponding corner portions of said upper and lower frames, respectively, and extending therebetween, and a cover for said skeletal frame including an upstanding peripherally continuous sleeve of flexible material having open upper and lower ends, said sleeve being downwardly telescoped over said frame, the upper end of said sleeve including inwardly directed peripherally adjacent and extending upper end flaps projecting inwardly over the marginal members of said upper frame, adjacent ends of said flaps being secured relative each other, said sleeve also including peripherally extending lower end flaps on its lower end directed inwardly beneath said lower frame, said sleeve, intermediate the opposite ends of one of said lower end flaps including a slot cut through said one lower end flap and also an upstanding slit extending upwardly along said sleeve from the lower end thereof to a point spaced below the upper end thereof, said slot and slit including communicated adjacent ends, means removably closing said slit, and means releasably closing said slot, said upper and lower frames each including corner connectors removably joining adjacent ends of the corresponding marginal members.

5. The hunting blind of claim 4 wherein said marginal members and spacing members are constructed of PVC.

6. A hunting blind including a skeletal frame incorporating upper and lower open frames of generally the same shape, said upper and lower frames each including a plurality of generally horizontal peripherally spaced and extending marginal members including adjacent ends, connecting means connecting adjacent ends of said marginal members of each of said upper and lower frames, corresponding connecting means of said frames being joined by upstanding, elongated spacing members including upper and lower ends extending between and interconnecting said corresponding connecting means, a cover for said skeletal frame including an upstanding peripherally continuous sleeve of flexible material having open upper and lower ends, said sleeve being telescoped over said frame, the upper end of said sleeve including inwardly directed peripherally adjacent and extending upper end flaps projecting inwardly over the marginal members of said upper frame with adjacent ends of said upper end flaps being secured relative to each other, said sleeve also including peripherally extending lower end flaps on its lower end directed inwardly beneath the marginal members of said lower frame, said sleeve, intermediate the opposite ends of one of said lower end flaps including a slot cut through said one lower end flap and also an upstanding slip extending upwardly along said sleeve from the lower end thereof to a point spaced below the upper end thereof, said slot and slit including communicated adjacent ends, means removably closing said slit and means removably closing said slot.

* * * * *